US012504009B2

(12) United States Patent
Bassani et al.

(10) Patent No.: US 12,504,009 B2
(45) Date of Patent: Dec. 23, 2025

(54) RECIPROCATING COMPRESSOR WITH A PRESSURE-DROP CHAMBER AND METHOD

(71) Applicant: NUOVO PIGNONE TECNOLOGIE SRL, Florence (IT)

(72) Inventors: Simone Bassani, Florence (IT); Francesco Chiesi, Florence (IT); Niccolo' Batini, Florence (IT); Massimo Bargiacchi, Florence (IT); Andrea Tenze, Florence (IT); Francesco Cangioli, Florence (IT)

(73) Assignee: Nuovo Pignone Tecnologie SRL, Florence (IT)

( * ) Notice: Subject to any disclaimer, the term of this patent is extended or adjusted under 35 U.S.C. 154(b) by 31 days.

(21) Appl. No.: 18/579,904

(22) PCT Filed: Jul. 15, 2022

(86) PCT No.: PCT/EP2022/025331
§ 371 (c)(1),
(2) Date: Jan. 17, 2024

(87) PCT Pub. No.: WO2023/001405
PCT Pub. Date: Jan. 26, 2023

(65) Prior Publication Data

US 2024/0328411 A1 Oct. 3, 2024

(30) Foreign Application Priority Data

Jul. 22, 2021 (IT) ..... 102021000019502

(51) Int. Cl.
*F04B 53/06* (2006.01)
*F04B 39/00* (2006.01)
*F04B 39/04* (2006.01)

(52) U.S. Cl.
CPC ..... *F04B 53/06* (2013.01); *F04B 39/0022* (2013.01); *F04B 39/041* (2013.01)

(58) Field of Classification Search
CPC .... F04B 53/06; F04B 39/0022; F04B 39/041; F04B 35/01; F04B 25/02; F04B 39/128; F04B 39/123
See application file for complete search history.

(56) References Cited

U.S. PATENT DOCUMENTS 3,491,654 A 1/1970 Zurcher
8,181,460 B2 5/2012 Mcquary et al.
(Continued)

FOREIGN PATENT DOCUMENTS

CN 104564604 A 4/2015
CN 207377760 U 5/2018
(Continued)

OTHER PUBLICATIONS

Downstream Segment, "Reciprocating compressors for petroleum, chemical, and gas industry services", ANSI/API Standard 618-2009 Fifth Edition, Dec. 2007.
(Continued)

*Primary Examiner* — Dominick L Plakkoottam
(74) *Attorney, Agent, or Firm* — Paul Frank + Collins P.C.

(57) ABSTRACT

The reciprocating compressor comprises a compressor frame, a crankshaft and a connecting rod, connecting the crankshaft to a crosshead. A piston rod connects a piston to the crosshead. The piston reciprocates in a gas compression cylinder. At least one pressure-drop module is positioned between the gas compression cylinder and a crosspiece guide. The piston rod extends from the gas compression
(Continued)

cylinder through a pressure-drop chamber of the pressure-drop module. Also disclosed herein is a method of operating a reciprocating compressor.

12 Claims, 2 Drawing Sheets

(56) References Cited

U.S. PATENT DOCUMENTS

| | | | | |
|---|---|---|---|---|
| 10,883,483 | B2 | 1/2021 | Chalk | |
| 10,900,476 | B2 | 1/2021 | Brun et al. | |
| 12,037,994 | B2 * | 7/2024 | Ukai | F04B 53/02 |
| 2005/0260080 | A1 * | 11/2005 | Miura | F04B 5/02 417/313 |
| 2012/0134850 | A1 * | 5/2012 | Grant | F04B 49/10 417/63 |
| 2015/0086388 | A1 | 3/2015 | Hold et al. | |
| 2016/0090980 | A1 * | 3/2016 | Howard | F04B 39/0005 417/63 |
| 2016/0245274 | A1 * | 8/2016 | Nagura | F04B 39/12 |
| 2018/0066802 | A1 * | 3/2018 | Brun | F17D 1/12 |
| 2019/0186478 | A1 * | 6/2019 | Cappelli | F04B 27/02 |

FOREIGN PATENT DOCUMENTS

| | | | |
|---|---|---|---|
| EP | 3 284 940 | A1 | 2/2018 |
| GB | 1 487 311 | A | 9/1977 |
| JP | 2021032140 | A | 3/2021 |
| KR | 20190081549 | A | 7/2019 |
| WO | 2020208930 | A1 | 10/2020 |

OTHER PUBLICATIONS

Southwest Research Institute, "Novel Seal Design for Effective Mitigation of Methane Emissions from Reciprocating Compressors", 2019.

* cited by examiner

RECIPROCATING COMPRESSOR WITH A PRESSURE-DROP CHAMBER AND METHOD

TECHNICAL FIELD

The present disclosure concerns improvements in gas compressors. Embodiments disclosed herein specifically relate to reciprocating compressors.

BACKGROUND ART

Pressure of a process gas can be boosted using several kinds of compressors depending, among others, by the compression ratio and flow rate required.

Reciprocating compressors are typically used when low flow rate and high compression ratio are necessary. Reciprocating compressors typically include a compressor frame, with a crankshaft supported for rotation therein. The crankshaft is driven into rotation by a driver, for instance an electric motor, or a turbine. The rotary motion of the crankshaft is converted into a reciprocating motion to control the reciprocating sliding movement of a piston in a gas compression cylinder.

The rotary motion is converted into reciprocating motion by a connecting rod, which drivingly couples the crankshaft to a crosshead, arranged for reciprocating motion in a crosshead guide. The crosshead is in turn drivingly coupled to a first end of a piston rod. The opposite, second end of the piston rod is connected to the piston, which is reciprocatingly moving inside the gas compression cylinder. A distance piece is positioned between the crosshead guide and the gas compression cylinder. The piston rod slides through the distance piece. The distance piece has an inner volume which is maintained at ambient pressure, or at a gas pressure slightly above ambient pressure.

The reciprocating movement of the piston in the gas compression cylinder, in combination with automatic or controlled suction valves and discharge valves, cause suction of process gas at a suction pressure and discharge of compressed process gas at a discharge pressure, higher than the suction pressure.

To prevent process gas leakages from the gas compression cylinder to the distance piece, a piston rod pressure packing is positioned around the piston rod on the back side of the gas compression cylinder chamber (crank end), i.e. facing the crosshead. The differential pressure across the piston rod pressure packing fluctuates according to the pressure inside the compression chamber, defined by the piston and the gas compression cylinder. The maximum value is equal to the difference between the process gas delivery pressure in the gas compression cylinder and the pressure in the distance piece, which is equal or almost equal to ambient pressure.

In order to prevent leakages along the piston rod, the piston rod pressure packing must seal the side surface of the piston rod. The higher the differential pressure across the piston rod pressure packing, the higher is the contact pressure of the sealing rings of the piston rod pressure packing against the side surface of the piston rod. This poses a limitation on the maximum allowable discharge pressure achievable by the compressor, especially if the piston rod pressure packing is a dry pressure packing, i.e. not using a lubricant. Dry packings are applied when contamination of the compressed gas is not allowed by specific process application.

It would therefore be welcomed in the art a reciprocating compressor capable of overcoming or alleviating the limitations of the reciprocating compressors of the current art.

SUMMARY

According to embodiments disclosed herein, a reciprocating compressor is provided, including a compressor frame, with a crankshaft supported for rotation therein. A connecting rod connects the crankshaft to a crosshead, arranged for reciprocating motion in a crosshead guide, to convert rotary motion of the crankshaft into reciprocating motion of the crosshead. A piston rod is coupled at one end to the crosshead and at the opposite end to a piston, which is arranged for reciprocating movement in a gas compression cylinder. At least one pressure-drop module is positioned between the gas compression cylinder and the crosspiece guide. The first pressure-drop module includes a pressure-drop chamber. The piston rod extends from the gas compression cylinder through the pressure-drop chamber. In use, the pressure-drop chamber is adapted to be purged with process gas at a pressure lower than a delivery pressure of the reciprocating compressor and higher than ambient pressure.

The disclosure also concerns a method of operating the reciprocating compressor.

BRIEF DESCRIPTION OF THE DRAWINGS

Reference is now made briefly to the accompanying drawings, in which.

DETAILED DESCRIPTION

In order to reduce the differential pressure across piston rod pressure packing acting on the piston rod, a pressure-drop chamber is provided between the gas compression cylinder and the crosshead guide of a reciprocating compressor. The pressure-drop chamber is maintained at a pressure which is lower than the compressor delivery pressure and higher than ambient pressure, for instance at a pressure around the suction pressure of the reciprocating compressor. The pressure differential between the compressor delivery pressure and ambient pressure is thus divided on at least two piston rod pressure packings. Sealing against leakages along the piston rod can thus be achieved at a reduced pressure of the packing against the side surface of the piston rod.

Figure 1:
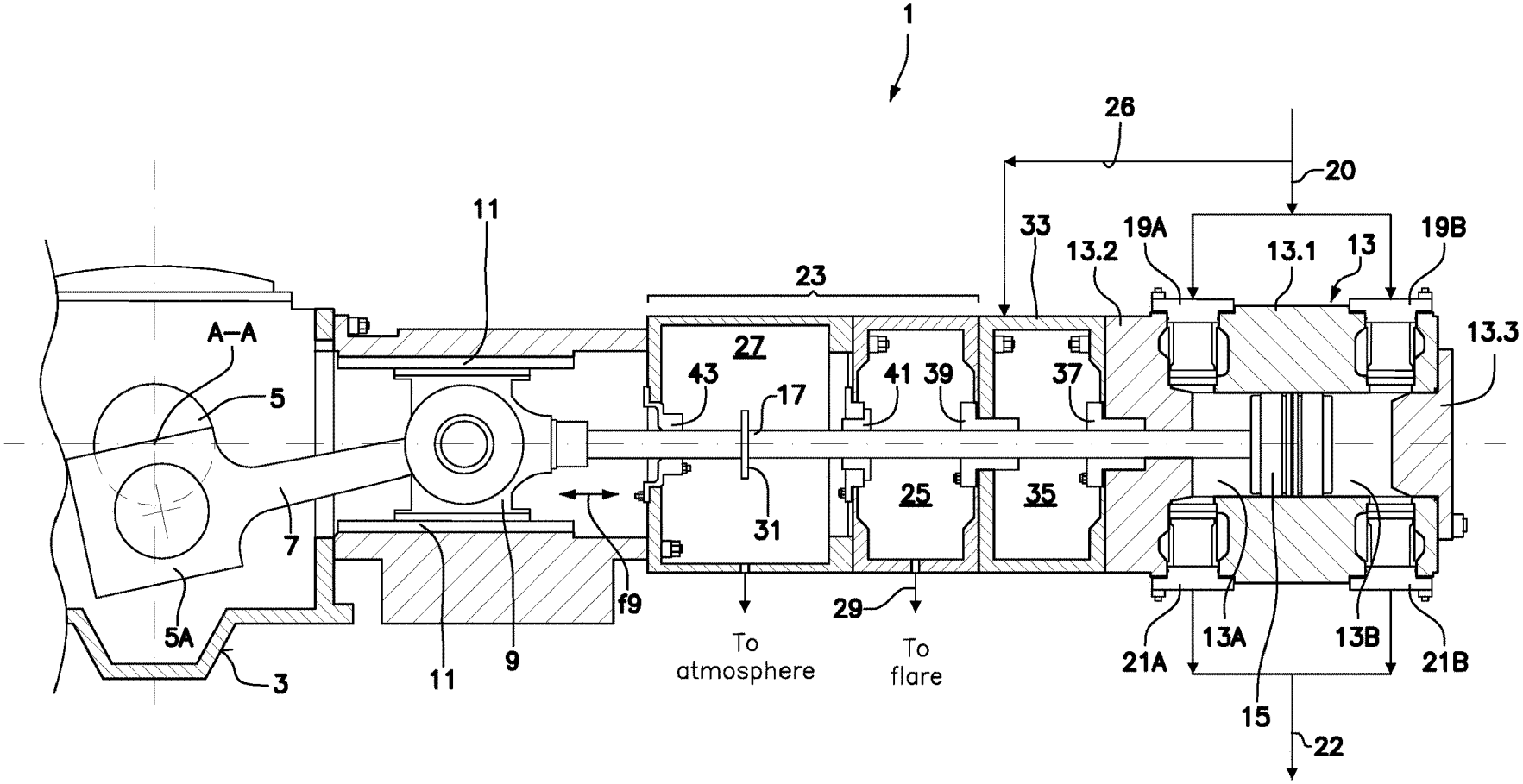
FIG. 1 is a sectional view of a reciprocating compressor according to the disclosure in one embodiment.

Turning now to FIG. 1, a reciprocating compressor 1 includes a compressor frame 3, which receives a crankshaft 5 arranged for rotation in the compressor frame 3 around a rotation axis A-A. A connecting rod 7 drivingly connects the crankshaft 5 to a crosshead 9. The crosshead 9 is arranged for slidingly reciprocating along a crosshead guide 11 according to double arrow f9 when the crankshaft 5 rotates with a continuous motion around axis A-A.

The reciprocating compressor 1 further includes a gas compression cylinder 13, including a cylinder body 13.1, a crank end 13.2 and a head end 13.3. A piston 15 is slidingly arranged in the inner volume of the gas compression cylinder 13 and divides the inner volume of the gas compression cylinder 13 into a first compression chamber 13A and a second compression chamber 13B. The reciprocating compressor 1 of FIG. 1 is therefore a double-acting reciprocating compressor.

The piston 15 is connected to an end of a piston rod 17, the opposite end whereof is connected to the crosshead 9 and reciprocates in the gas compression cylinder 13.

The gas compression cylinder 13 further includes at least one suction valve for each compression chamber 13A, 13B. The suction valves are shown at 19A and 19B, respectively, and are in fluid connection with a suction line 20. Each compression chamber 13A, 13B is further provided with a respective discharge valve 21A, 21B. The discharge valves 21A, 21B are fluidly coupled to a delivery line 22.

In some embodiments, a distance piece 23 is positioned between the crosshead guide 11 and the gas compression cylinder 13. In the embodiment of FIG. 1, the distance piece 23 includes a first inner volume 25 and a second inner volume 27. The first inner volume 25 can be fluidly coupled at 29 with a flare stack, where process gas leaking in the first inner volume 25 is flared. The pressure inside the first inner volume 25 is therefore slightly above ambient pressure, to allow gas to be delivered to the flare stack. The second inner volume 27 can be maintained at ambient pressure. An oil slinger 31 can be fitted on the piston rod 17 in the portion thereof crossing the second inner volume 27 of the distance piece 23.

The reciprocating compressor 1 further includes a pressure-drop module 33 positioned between the distance piece 23 and the gas compression cylinder 13. The pressure-drop module 33 includes a pressure-drop chamber 35 through which the piston rod 17 extends.

A first piston rod pressure packing 37 surrounding the piston rod 17 is positioned between the gas compression cylinder 13 and the pressure-drop chamber 35. A second piston rod pressure packing 39 is positioned between the pressure-drop chamber 35 and the crosspiece guide 11 and more specifically between the pressure-drop chamber 35 and the distance piece 23. In the embodiment of FIG. 1, the second piston rod pressure packing 39 is positioned between the pressure-drop chamber 35 and the first inner volume 25 of the distance piece 23. A further piston rod intermediate pressure packing 41 can be arranged between the first inner volume 25 and the second inner volume 27 of the distance piece 23.

An oil wiper packing 43 can be arranged around the piston rod 17, between the second inner volume 27 of the distance piece 23 and the crosshead guide 11.

In some embodiments, the pressure-drop chamber 35 is fluidly coupled to a source of process gas at a pressure lower than the delivery pressure, but higher than the pressure in the first inner volume 25 of the distance piece 23. In the embodiment of FIG. 1, the pressure-drop chamber 35 is fluidly coupled to the suction line 20 of the reciprocating compressor 1. The pressure inside the pressure-drop chamber 35 is thus substantially equal to the suction pressure of the reciprocating compressor 1. In some embodiments, not shown, the pressure in the pressure-drop chamber 35 can be adjusted to be lower than the suction pressure, e.g., by providing a pressure reducing valve in the line 26 which connects the pressure-drop chamber 35 to the suction line 20.

With the above described arrangement, the maximum differential pressure across the first piston rod pressure packing 37 is equal to the difference between the delivery pressure and the suction pressure of the reciprocating compressor 1 and the differential pressure across the second piston rod pressure packing 39 is equal to the difference between the suction pressure and the pressure in the first volume 25 of the distance piece 23, which may be almost equal to the ambient pressure.

The maximum differential pressure across a single piston rod pressure packing is thus reduced with respect to reciprocating compressor configurations of the current art.

If desired, more than one pressure-drop module 33 can be arranged between the crank end 13.2 of the gas compression cylinder 13 and the distance piece 23, such as to split the difference between the delivery pressure and the pressure in the first inner volume 25 of the distance piece 23 across more than just two piston rod pressure packings. For instance, two or three pressure-drop modules 33 can be arranged in sequence between the crank end 13.2 and the distance piece 23. Each pressure-drop room of the plurality of pressure-drop modules can be fluidly coupled to sources of process gas at progressively lower pressure values. For instance, the first pressure-drop chamber 35, i.e. the one adjacent the gas compression cylinder 13 can be coupled to the suction side of the reciprocating compressor 1, and a second pressure-drop chamber can be fluidly coupled to the suction side of a reciprocating compressor arranged in series upstream the reciprocating compressor 1. In other embodiments, the second pressure-drop chamber can be fluidly coupled to the suction line 20 with the interposition of a pressure reduction valve, such that the pressure in the second pressure-drop chamber is lower than the pressure in the first pressure drop chamber.

In the embodiment of FIG. 1, a distance piece 23 divided into two parts with a first inner volume 25 and a second inner volume 27 is provided. In other embodiments, a shorter distance piece with just one inner volume can be provided, which can be fluidly coupled to the environment or to a process gas recovery line, e.g. fluidly coupled to a flare stack.

While in FIG. 1 the pressure-drop chamber 35 is fluidly coupled to the suction side of the reciprocating compressor 1, in other embodiments the pressure-drop chamber 35 can be fluidly coupled to a different source of process gas, for instance at a pressure lower than the suction pressure. In embodiments, the source of process gas to which the pressure-drop chamber 35 is connected can be the suction side of a compressor stage arranged upstream of the gas compression cylinder 13.

Figure 2:
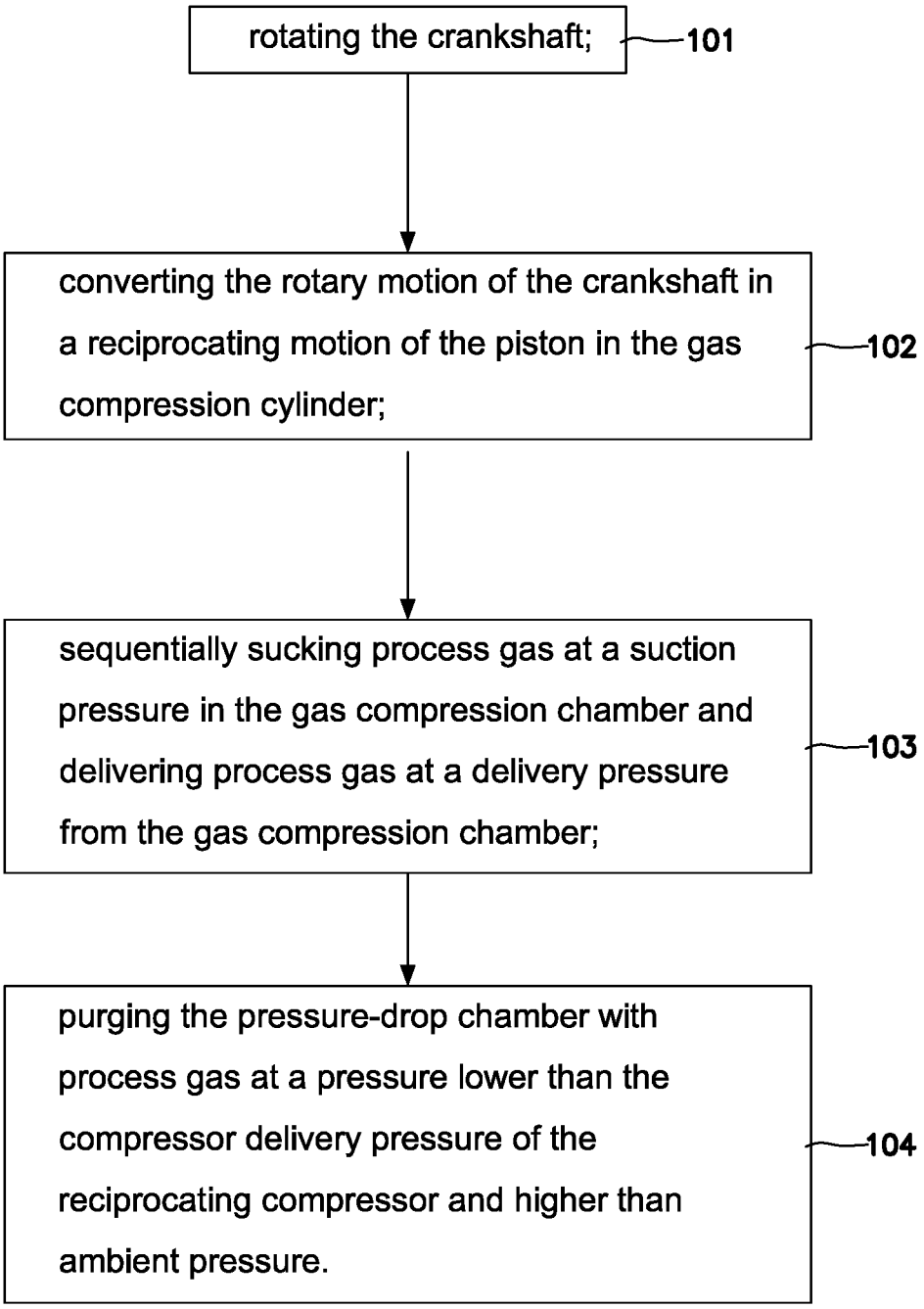
FIG. 2 is a flow chart of a method of operating the reciprocating compressor.

FIG. 2 illustrates a flowchart, which summarizes a method for operating a reciprocating compressor 1 according to the present disclosure The method comprises the following steps:

- rotating the crankshaft 5 (step 101);
- converting the rotary motion of the crankshaft 5 in a reciprocating motion of the piston 15 in the gas compression cylinder 13 (step 102);
- sequentially sucking process gas at as suction pressure in the gas compression chamber and discharging process gas at a delivery pressure from the gas compression chamber (step 103); and
- purging the pressure-drop chamber 35 with process gas at a pressure lower than the delivery pressure of the reciprocating compressor and higher than ambient pressure (step 104).

The mentioned steps may be performed in any suitable order. During steady-state operation of the compressor 1, the above mentioned steps are usually performed in parallel, i.e. at the same time.

Exemplary embodiments have been disclosed above and illustrated in the accompanying drawings. It will be understood by those skilled in the art that various changes, omissions and additions may be made to that which is specifically disclosed herein without departing from the scope of the invention as defined in the following claims.

The invention claimed is:

1. A reciprocating compressor configured to pressurize process gas to a delivery pressure, the reciprocating compressor comprising:

a compressor frame with a crankshaft supported for rotation therein;

a connecting rod connected to the crankshaft;

a crosshead connected to the connecting rod;

a crosspiece guide arranged to receive the crosshead therein;

a piston rod having a first end coupled to the crosshead;

a piston coupled to a second end of the piston rod;

a gas compression cylinder comprising a cylinder body with an inner volume to receive the piston therein;

a suction line coupled to the gas compression cylinder;

a pressure-drop module positioned between the gas compression cylinder and the crosspiece guide, the pressure-drop module comprising a pressure-drop chamber; and a distance piece positioned between the pressure-drop module and the crosspiece guide, the distance piece comprising a first inner volume, wherein the piston rod extends from the gas compression cylinder through the pressure-drop chamber and the first inner volume, and wherein, in use, the first inner volume receives process gas at a gas recovery pressure, and the pressure-drop chamber receives process gas at a pressure lower than the delivery pressure of the process gas and higher than the gas recovery pressure.

2. The reciprocating compressor of claim 1, further comprising:

a first piston rod pressure packing positioned between the gas compression cylinder and the pressure-drop chamber.

3. The reciprocating compressor of claim 1, further comprising:

a first piston rod pressure packing positioned between the gas compression cylinder and the pressure-drop chamber; and a second piston rod pressure packing positioned between the pressure-drop chamber and the crosspiece guide, wherein the second piston rod pressure packing is positioned between the pressure-drop chamber and the distance piece.

4. The reciprocating compressor of claim 1, wherein the distance piece further comprises a second inner volume at ambient pressure.

5. The reciprocating compressor of claim 2, further comprising:

a first piston rod pressure packing positioned between the gas compression cylinder and the pressure-drop chamber;

a second piston rod pressure packing positioned between the pressure-drop chamber and the crosspiece guide; and an intermediate piston rod pressure packing, wherein the distance piece further comprises a second inner volume at ambient pressure, wherein the intermediate piston rod pressure packing is positioned between the first inner volume and the second inner volume, and wherein the first piston rod pressure packing, the second piston rod pressure packing, and the intermediate packing are dry pressure packings.

6. The reciprocating compressor of claim 1, wherein the pressure of the process gas is around a suction pressure in the suction line.

7. The reciprocating compressor of claim 1, further comprising:

a fluid connection line coupled to the suction line and to the pressure-drop chamber, wherein, in use, the pressure-drop chamber receives process gas at around a suction pressure in the suction line.

8. A method of operating a reciprocating compressor, the method comprising:

on a reciprocating compressor comprising a crankshaft supported for rotation in a compressor frame, a crosshead, a crosshead guide for receiving the crosshead, a connecting rod connecting the crankshaft to the crosshead, a piston rod coupled to the crosshead on a first end, a piston coupled to a second end of the piston rod, a gas compression cylinder comprising a cylinder body with an inner volume to receive the piston, and a pressure-drop module positioned between the gas compression cylinder and the crosshead guide, the pressure-drop module comprising a pressure-drop chamber formed therein, and a distance piece disposed between the crosspiece guide and the pressure-drop module, the distance piece comprising a first inner volume rotating the crankshaft;

converting the rotary motion of the crankshaft into a reciprocating motion of the piston in the gas compression cylinder;

sequentially sucking process gas at a suction pressure in the gas compression cylinder and discharging process gas at a delivery pressure from the compression cylinder;

allowing process gas in the first inner volume to flow to a flare stack;

and purging the pressure-drop chamber with process gas at a pressure lower than the delivery pressure of the reciprocating compressor and higher than the pressure in the first inner volume.

9. The method of claim 8, wherein the pressure-drop chamber is purged with process gas at a pressure around the suction pressure.

10. The method of claim 8, further comprising: maintaining the first inner volume of the distance piece at a pressure around ambient pressure that is lower than the pressure of the pressure-drop chamber.

11. The reciprocating compressor of claim 1, wherein an intermediate piston rod packing is located between the first inner volume and the second inner volume of the distance piece.

12. The reciprocating compressor of claim 1, further comprising:

an oil wiper packing positioned between the second inner volume and the crosshead guide.

* * * * *